United States Patent [19]

Mortimer

[11] Patent Number: 4,639,931

[45] Date of Patent: Jan. 27, 1987

[54] INDUCTION FURNACE PACKAGING SYSTEM

[75] Inventor: John H. Mortimer, Medford, N.J.

[73] Assignee: Inductotherm Industries, Inc., Rancocas, N.J.

[21] Appl. No.: 761,272

[22] Filed: Aug. 1, 1985

[51] Int. Cl.[4] ..... H05B 5/00

[52] U.S. Cl. ..... 373/138; 373/142; 373/151

[58] Field of Search ..... 373/138, 142, 143, 151–158, 373/150; 266/142; 432/62, 93; 219/10, 75

[56] References Cited

U.S. PATENT DOCUMENTS

| | | | |
|---|---|---|---|
| 1,246,148 | 11/1917 | Owens . | |
| 1,288,975 | 12/1918 | Owens . | |
| 1,452,856 | 4/1923 | Trinks . | |
| 2,176,674 | 10/1939 | Lindemuth | 263/15 |
| 2,408,350 | 9/1946 | Strickland, Jr. | 219/13 |
| 2,681,971 | 6/1954 | Strickland, Jr. et al. | 373/150 |
| 2,768,226 | 10/1956 | Rowan, Jr. et al. | 373/151 |

*Primary Examiner*—Roy N. Envall, Jr.

*Attorney, Agent, or Firm*—Seidel, Gonda, Goldhammer & Abbott

[57] ABSTRACT

A packaging system for an induction furnace has an equipment housing within which is located all the operating equipment for the furnace. The equipment is centrally located within the housing and is reached from either side by access panels in the housing cover, which forms a deck. The operating equipment is fully enclosed and protected by the housing, yet can be easily reached by means of the access panels for maintenance, trouble shooting and the like.

3 Claims, 3 Drawing Figures

FIG. 2
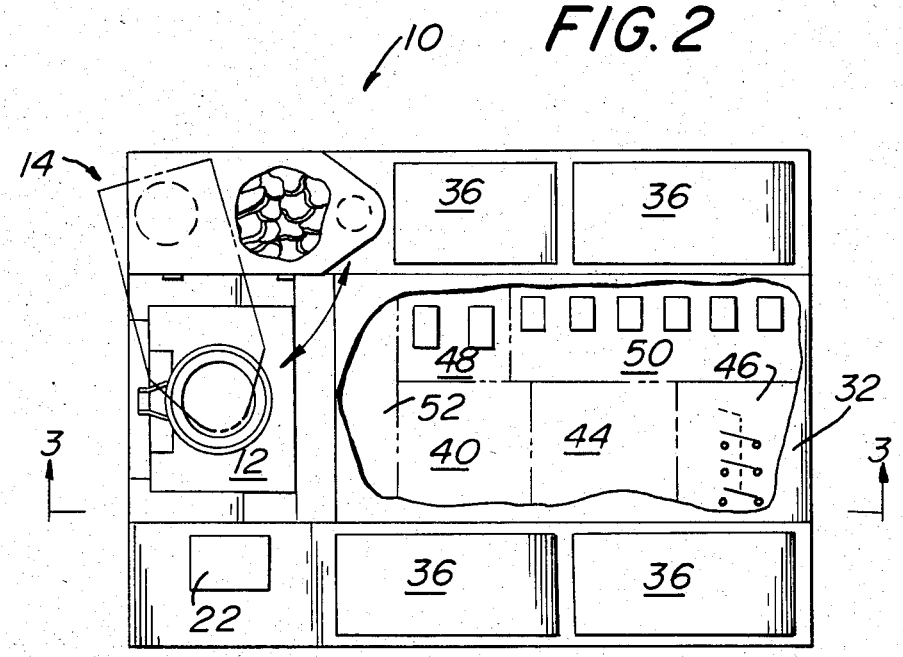
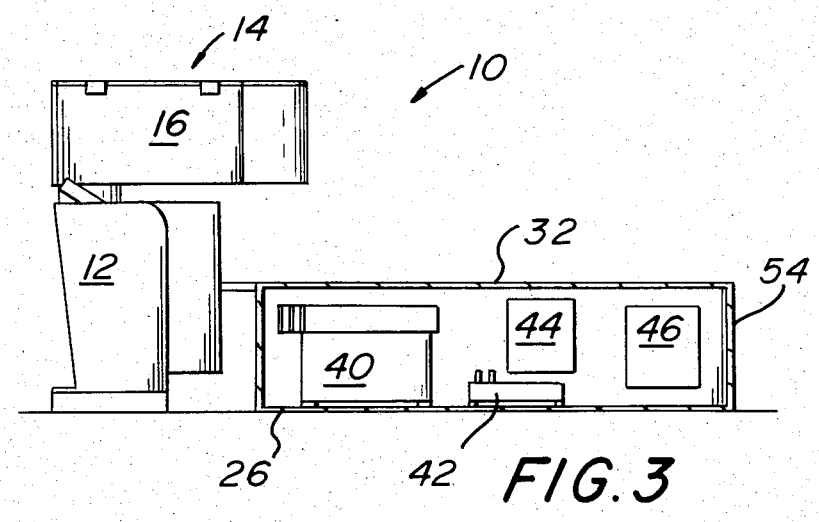
FIG. 3

INDUCTION FURNACE PACKAGING SYSTEM

BACKGROUND OF THE INVENTION

Induction furnaces of less than five ton capacity have in the past been sold with their power supplies in a heavy gauge cubicle and the furnace separate therefrom. It has been up to the customer to install and provide platforms and supports for the furnaces and power supply cubicles. In cases where the furnaces and the power supplies have been packaged together, the packaging has been done in such a way that many of the furnace components are located in structures that protrude above the deck working area. Attempts to locate some of the components below a prepackaged deck have necessitated removal of deck plates to work directly underfoot to do maintenance on the equipment.

There is a need for a packaging system that incorporates an open deck area where only the necessary operating controls protrude above the deck area and the remaining furnace components are under the deck area, but arranged so that access for maintenance purposes is from the side rather than directly underfoot. The present invention fulfils this need.

SUMMARY OF THE INVENTION

The invention is a packaging system for induction furnaces and comprises a housing adjacent to the furnace and having a base, upstanding side walls and a top wall. The base, side walls and top walls define an enclosed space. Furnace operating equipment is located within the enclosed space, and means are provided in the housing for providing access to the furnace operating equipment.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 2 is a plan view of the furnace packaging system shown in FIG. 1.

FIG. 3 is a sectional view taken along the lines 3—3 in FIG. 2.

DESCRIPTION OF THE INVENTION

Figure 1:
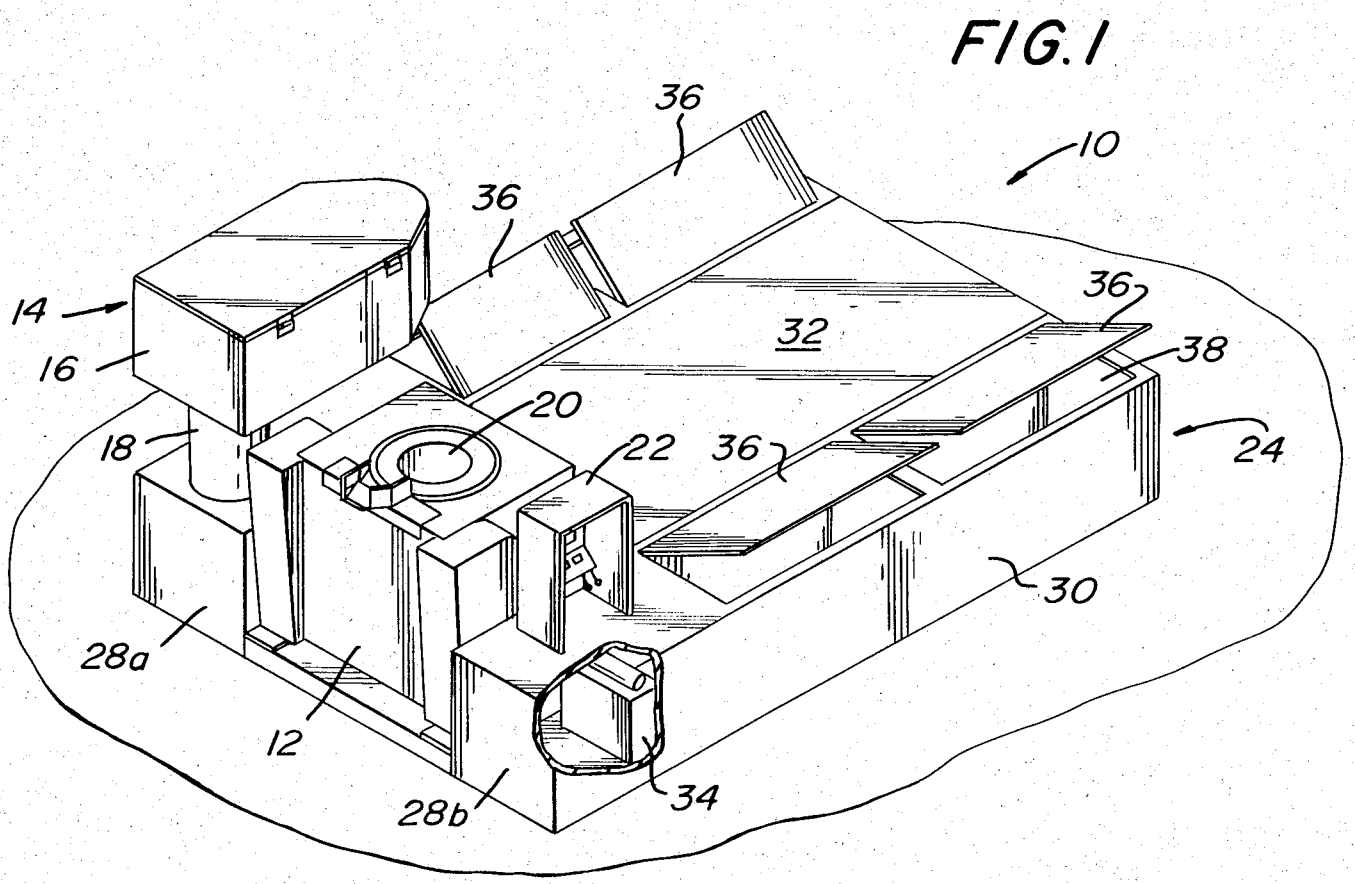
FIG. 1 is an isometric view of a furnace packaging system in accordance with the present invention.

Referring now to the drawings, wherein like numerals indicate like elements, there is shown in FIG. 1 a furnace packaging system in accordance with the present invention designated generally by the reference numeral 10. The system includes a conventional induction furnace 12 and a charging conveyor 14. Induction furnace 12 may be any conventional induction furnace, and therefore need not be described in further detail here. Charging conveyor 14 is also conventional, and includes a hopper 16 mounted on a post 18, and is arranged to pivot over furnace core 20 to feed material to be melted into furnace 12. Because charging conveyor 14 is conventional, it is not necessary to explain it in any great detail here.

The furnace packaging system 10 incudes an equipment housing 24 which houses all of the furnace operating equipment internally with the exception of operator control console 22, which contains the controls, switches, meters, and the like, which must be readily accessible to an operator.

Housing 24 includes a base 26, side walls 28*a*, 28*b* and 30, and cover 32. Cover 32 forms a deck on which workmen and furnace operators can stand. Housing 24 also includes a side wall 54 opposite side walls 28*a*, 28*b* and a side wall (not visible in the drawings) opposite side wall 30. Base 26, the side walls and cover 32 define an enclosed space within which is located the furnace operating equipment. As best illustrated in FIGS. 2 and 3, conventional induction furnace operating equipment such as hydraulic power supply 34, invertor panel 40, current limiting reactors 42, automatic circuit interruptor 44, air-operated disconnects 46, dc filter 48 and power factor correction capacitors 50 are all enclosed within housing 24. Also enclosed within housing 24 are the electrical connections between the operating equipment and furnace 12. The specific types of operating equipment enumerated are illustrative only and the invention is not limited to enclosing any specific equipment or combinations of equipment.

Access to the furnace operating equipment is by means of access panels 36 in cover 32. Access panels 36 may be hingedly mounted in cover 32 or may be removably mounted therein. Access panels 36 when raised provide access to spaces 38, which are large enough to permit a workman to enter therein in order to maintain and/or repair the furnace operating equipment. When access panels 36 are lowered, they fit flush with the surface of cover 32 so as to form a continuous deck.

Access panels 36 may also be located in one or more of the side walls of housing 24. However, when access panels 36 are located in cover 32, a number of furnaces 10 may be grouped together in abutting relationship, minimizing required floor space while still permitting easy and safe access to the furnace operating equipment.

It will be appreciated that, except for the operator control console which must be located above deck level, all of the furnace operating equipment is enclosed safely within housing 24 so that risk of damage to the operating components is greatly minimized. Moreover, instead of having to work on the furnace operating equipment from above, workmen have access to the equipment from the sides by means of access spaces 38. This simplifies maintenance by allowing access to the equipment from two sides rather than from just the top.

The present invention may be embodied in other specific forms without departing from the spirit or essential attributes thereof and, accordingly, reference should be made to the appended claims, rather than to the foregoing specification, as indicating the scope of the invention.

I claim:

1. A packaging system for an induction furnance comprising:

(a) housing means having a base, side walls and a top wall, the base, top and side walls defining an enclosed space, (b) an induction furnace contained substantially within the enclosed space, (c) furnace operating equipment centrally located within the enclosed space and defining spaces between the furnace operating equipment and side walls of the housing means, (d) access means in the top wall adjacent the spaces between the furnace operating equipment and the side walls for providing access to the spaced and access to the furnace operating equipment from the sides thereof while preventing access to the furnace operating equipment from the top thereof, (e) induction furnace charging means mounted on the housing means adjacent the induction furnace and pivotable with respect thereto for charging the induction furnace with metal to be melted, and (f) furnace control housing means mounted on the top wall and adjacent the induction furnace.

2. A packaging system according to claim 1, wherein the access means comprises at least one panel flush with the top wall and hingedly mounted therein.

3. A packaging system for an induction furnace comprising:

(a) a substantially rectangular housing having a base, side walls and a top wall and defining an enclosed space therein, (b) an induction furnace at one end of the housing and contained substantially within the enclosed space, the induction furnace having means extending above the top wall of the housing for receiving a charge of metal to be melted by the furnace, (c) furnace operating equipment centrally located within the enclosed space at the end of the housing opposite the induction furnace and defining channels between the furnace operating equipment and two side walls of the housing, (d) hinged access panels in the top wall above the channels between the furnace operating equipment and the side walls for providing access to the channels and access to the furnace operating equipment from the sides thereof while preventing access to the furnace operating equipment from the top thereof, (e) induction furnace charging means mounted on the housing means adjacent the induction furnace and pivotable with respect thereto for charging the furnace with metal to be melted, and (f) furnace control housing means mounted on the top wall and adjacent the induction furnace, and having a back wall adjacent the furnace and side walls and a top wall extending away from the furnace, the furnace control housing being substantially open along a plane parallel to the back wall and spaced apart therefrom by the length of the side and top walls of the furnace control housing.

* * * * *